US009373341B2

(12) United States Patent
Gunawan et al.

(10) Patent No.: US 9,373,341 B2
(45) Date of Patent: Jun. 21, 2016

(54) METHOD AND SYSTEM FOR BIAS CORRECTED SPEECH LEVEL DETERMINATION

(71) Applicant: DOLBY LABORATORIES LICENSING CORPORATION, San Francisco, CA (US)

(72) Inventors: David Gunawan, Sydney (AU); Glenn Dickins, Como (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 21 days.

(21) Appl. No.: 14/384,586

(22) PCT Filed: Mar. 21, 2013

(86) PCT No.: PCT/US2013/033312

§ 371 (c)(1),
(2) Date: Sep. 11, 2014

(87) PCT Pub. No.: WO2013/142695

PCT Pub. Date: Sep. 26, 2013

(65) Prior Publication Data

US 2015/0058010 A1 Feb. 26, 2015

Related U.S. Application Data

(60) Provisional application No. 61/614,599, filed on Mar. 23, 2012.

(51) Int. Cl.
*G10L 25/78* (2013.01)
*G10L 21/0316* (2013.01)
(Continued)

(52) U.S. Cl.
CPC ..... *G10L 21/0316* (2013.01); *G10L 25/18* (2013.01); *G10L 25/48* (2013.01); *G10L 25/78* (2013.01); *G10L 25/21* (2013.01)

(58) Field of Classification Search
CPC ... G10L 19/00; G10L 19/017; G10L 19/0018; G10L 19/02; G10L 19/0204; G10L 19/22; G10L 21/00; G10L 21/02; G10L 21/0232; G10L 21/0272; G10L 21/0316; G10L 25/00; G10L 25/18; G10L 25/21; G10L 25/78
USPC ..... 704/236, 233, 225, 208, 500, 501
See application file for complete search history.

(56) References Cited

U.S. PATENT DOCUMENTS 5,794,185 A 8/1998 Bergstrom
5,913,188 A * 6/1999 Tzirkel-Hancock .... G10L 15/02 704/221

(Continued)

FOREIGN PATENT DOCUMENTS

EP 1629463 8/2007
WO 2010/022453 3/2010

OTHER PUBLICATIONS

Byrne A et al., "An International Comparison of Long-Term Average Speech Spectra," Journal of the Acoustical Society of America 96 (4), pp. 2108-2120, Oct. 1994.

(Continued)

*Primary Examiner* — Qi Han

(57) ABSTRACT

Method for measuring level of speech determined by an audio signal in a manner which corrects for and reduces the effect of modification of the signal by the addition of noise thereto and/or amplitude compression thereof, and a system configured to perform any embodiment of the method. In some embodiments, the method includes steps of generating frequency banded, frequency-domain data indicative of an input speech signal, determining from the data a Gaussian parametric spectral model of the speech signal, and determining from the parametric spectral model an estimated mean speech level and a standard deviation value for each frequency band of the data; and generating speech level data indicative of a bias corrected mean speech level for each frequency band, including using at least one correction value to correct the estimated mean speech level for the frequency band, where each correction value has been predetermined using a reference speech model.

12 Claims, 6 Drawing Sheets

(51) Int. Cl.

| | |
|---|---|
| ***G10L 25/48*** | (2013.01) |
| ***G10L 25/18*** | (2013.01) |
| *G10L 25/21* | (2013.01) |

(56) References Cited

U.S. PATENT DOCUMENTS

| | | | | |
|---|---|---|---|---|
| 6,968,064 | B1 | 11/2005 | Ning | |
| 7,013,266 | B1 * | 3/2006 | Berger | G10L 25/69 704/203 |
| 7,209,567 | B1 | 4/2007 | Kozel | |
| 7,233,898 | B2 | 6/2007 | Byrnes | |
| 8,280,731 | B2 | 10/2012 | Yu | |
| 8,437,482 | B2 | 5/2013 | Seefeldt | |
| 2002/0097840 | A1 | 7/2002 | Hardy | |
| 2007/0055508 | A1 | 3/2007 | Zhao | |
| 2007/0150263 | A1 | 6/2007 | Zhang | |
| 2009/0299742 | A1 | 12/2009 | Toman | |
| 2010/0094625 | A1 | 4/2010 | Mohammad | |
| 2010/0191525 | A1 | 7/2010 | Rabenko | |
| 2011/0066430 | A1 | 3/2011 | Hetherington | |
| 2011/0153321 | A1 * | 6/2011 | Allen | G10L 21/0364 704/226 |
| 2011/0191102 | A1 | 8/2011 | Espy-Wilson | |
| 2011/0305345 | A1 | 12/2011 | Bouchard | |

OTHER PUBLICATIONS

Soulodre, G. et al., "Objective Measures of Loudness," Audio Engineering Society Convention Paper 5896, 115th Convention, pp. 1-9, Oct. 10-13, 2003.

Zha, W. et al., "Objective Speech Quality Measurement Using Statistical Data Mining," EURASIP Journal on Applied Signal Processing, vol. 2005, pp. 1410-1424, Jan. 1, 2005.

Seefeldt, A. et al., "A New Objective Measure of Perceived Loudness," Audio Engineering Society Convention Paper, New York, US, pp. 1-8, Oct. 28, 2004.

* cited by examiner

METHOD AND SYSTEM FOR BIAS CORRECTED SPEECH LEVEL DETERMINATION

CROSS-REFERENCE TO RELATED APPLICATIONS

This application claims priority to U.S. Patent Provisional Application No. 61/614,599, filed 23 Mar. 2012, which is hereby incorporated by reference in its entirety.

BACKGROUND OF THE INVENTION

1. Field of the Invention

Embodiments of the invention are systems and methods for determining the level of speech determined by an audio signal in a manner which corrects for, and thus reduces the effect of (is invariant to, in preferred embodiments) modification of the signal by addition of noise thereto and/or amplitude compression thereof.

2. Background of the Invention

Throughout this disclosure, including in the claims, the terms "speech" and "voice" are used interchangeably, in a broad sense to denote audio content perceived as a form of communication by a human being. Thus, "speech" determined or indicated by an audio signal may be audio content of the signal which is perceived as a human utterance upon reproduction of the signal by a loudspeaker (or other sound-emitting transducer).

Throughout this disclosure, including in the claims, the expression "speech data" (or "voice data") denotes audio data indicative of speech, and the expression "speech signal" (or "voice signal") denotes an audio signal indicative of speech (e.g., which has content which is perceived as a human utterance upon reproduction of the signal by a loudspeaker).

Throughout this disclosure, including in the claims, the expression "segment" of an audio signal assumes that the signal has a first duration, and denotes a segment of the signal having a second duration less than the first duration. For example, if the signal has a waveform of a first duration, a segment of the signal has a waveform whose duration is shorter than the first duration.

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X−M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

The accurate estimation of speech level is an important signal processing component in many systems. It is used, for example, as the feedback signal for the automatic control of gain in many communications system, and in broadcast it is used to determine and assign appropriate playback levels to program material.

Examples of conventional methods for estimating the loudness (level) of speech determined by an audio signal are described in Soulodre et al., "Objective Measures of Loudness," presented at the 115$^{th}$ Audio Engineering Society Convention, 2003 ("Soulodre").

Typical conventional speech level estimation methods operate on frequency domain audio data (indicative of an audio signal) to determine loudness levels for individual frequency bands of the audio signal. The levels then typically undergo perceptually relevant weighting (which attempts to model the transfer characteristics of the human auditory system) to determine weighted levels (the levels for some frequency bands are weighted more heavily than for some other frequency bands). For example, Soulodre discusses several types of conventional weightings of this type, including A-, B-, C-, RLB (Revised Low-frequency B), Bhp (Butterworth high-pass filter), and ATH weightings. Other conventional perceptually relevant weightings include D-weightings and M (Dolby) weightings.

As described in Soulodre, the weighted levels are typically summed and averaged over time to determine an equivalent sound level (sometimes referred to as "Leq") for each segment (e.g., frame, or N frames, where N is some number) of input audio data. For example, the level "Leq" may be computed as follows: a set of values $(x_W)^2/(x_{REF})^2$ is determined, where each value $x_W$ is the weighted loudness level corresponding to (e.g., produced at) a time, t, during the segment (so that each value $x_W$ is a weighted loudness level for one of the frequency bands), and $X_{REF}$ is a reference level for the frequency band; and Leq for the segment is computed to be $Leq=10\log_{10}(I/T)$, where I is the integral of the $(x_W)^2/(x_{REF})^2$ values over a time interval T, and T is of sufficient duration to include the times associated with the values $(x_W)^2/(x_{REF})^2$ for all the frequency bands.

However, in traditional methods and systems for measuring the level of a speech signal (e.g., a voice segment of an audio signal), the calculated level (e.g., Soulodre's "Leq") is highly dependent on the signal-to-noise ratio (SNR) of the signal and the type of amplitude compression applied to the signal. To appreciate this, consider a speech signal segment that has been compressed with various compression ratios, and noisy versions of each compressed version of the sample (having various different signal to noise ratios). The speech levels (Leq) determined by the conventional loudness estimating method described in Soulodre for such compressed, noisy samples would show a significant bias due to the presence of the signal modification (compression and noise).

For an example, consider FIG. 1, which is a graph of results of applying a conventional speech level estimating method to a range of input voice signals with varying levels and signal to noise ratio. For input voice signals having constant perceptual speech level, the conventionally estimated level has a strong bias determined by the signal to noise ratio, in the sense that the conventionally measured level increases as the signal to noise ratio decreases. In FIG. 1, the error in dB (plotted on the vertical axis) denotes the discrepancy between the conventionally measured (estimated) speech level and a reference RMS voice level calculated in the absence of noise. Thus, the graph shows that the conventionally measured level increases relative to the reference RMS voice level, as the signal to noise ratio decreases.

BRIEF DESCRIPTION OF THE INVENTION

In a class of embodiments, the present invention is a method of generating a speech level signal from a speech signal (e.g., a signal indicative of speech data, or another audio signal) indicative of speech, wherein the speech level signal is indicative of level of the speech, and the speech level signal is generated in a manner which corrects for bias due to presence of noise with and/or amplitude compression of the speech signal (and is preferably at least substantially invariant to changes in such bias due to addition of noise to the speech signal and/or amplitude compression of the speech signal). In typical embodiments, the speech signal is a voice segment of an audio signal (typically, one that has been identified using a voice activity detector), and the method includes a step of determining (from frequency domain audio data indicative of the voice segment) a parametric spectral model of content of the voice segment. Preferably, the parametric spectral model is a Gaussian parametric spectral model. The parametric spectral model determines a distribution (e.g., a Gaussian distribution) of speech level values (e.g., speech level at each of a number of different times during assertion of the speech signal) for each frequency band (e.g., each Equivalent Rectangular Bandwidth (ERB) or Bark frequency band) of the voice segment, and an estimated speech level (e.g., estimated mean speech level) for each frequency band of the voice segment. Taking advantage of the fact that speech has a relatively fixed dynamic range, "a priori" knowledge of the speech level distribution (for each frequency band) of typical (reference) speech is used to correct the estimated speech level determined for each frequency band (thereby determining a corrected speech level for each band), to correct for bias that may have been introduced by compression of, and/or the presence of noise with, the speech signal. Typically a reference speech model is predetermined, such that the reference speech model is a parametric spectral model determining a speech level distribution (for each frequency band) of reference speech, and the reference speech model is used to predetermine a set of correction values. The predetermined correction values are employed to correct the estimated speech levels determined for all frequency bands of the voice segment. The reference speech model can be predetermined from speech uttered by an individual speaker or by averaging distribution parameterizations predetermined from speech uttered by many speakers. The corrected speech levels for the individual frequency bands are employed to determine a corrected speech level for the speech signal.

In a class of embodiments, the inventive method includes steps of: (a) generating, in response to frequency banded, frequency-domain data indicative of an input speech signal (e.g., a voice segment of an audio signal identified by a voice activity detector), a Gaussian parametric spectral model of the speech signal, and determining from the parametric spectral model an estimated mean speech level and a standard deviation value for each frequency band (e.g., each ERB frequency band, Bark frequency band, or other perceptual frequency band) of the data; and (b) generating speech level data indicative of a bias corrected mean speech level for said each frequency band, including by using at least one correction value to correct the estimated mean speech level for the frequency band, wherein each said correction value has been predetermined using a reference speech model. Typically also, the method includes a step of: (c) generating a speech level signal indicative of a corrected speech level for the speech signal from the speech level data generated in step (b). Preferably, the reference speech model is Gaussian parametric spectral model of reference speech (which determines a level distribution for each frequency band of a set of frequency bands of the reference speech), and each of the correction values is a reference standard deviation value for one of the frequency bands of the reference speech.

In preferred embodiments in this class, step (b) includes a step of determining the bias corrected mean speech level for each frequency band, f, to be:

$$M_{biascorrected}(f)=M_{est}(f)+n(S_{est}(f)-S_{prio}(f) \quad (1)$$

where $M_{biascorrected}(f)$ is the bias corrected mean speech level for band f, $M_{est}(f)$ is the estimated mean speech level for frequency band f (determined from the input speech signal), $S_{est}(f)$ is the standard deviation value (determined from the input speech signal) for frequency band f, and $S_{prio}(f)$ is a reference standard deviation (predetermined from the reference speech model) for frequency band f. Typically, the preferred embodiments include a step of: (c) determining a corrected speech level for the speech signal from the bias corrected mean speech levels, $M_{biascorrected}(f)$, determined using equation (1). The parameter n in equation (1) is a predetermined integer, which is preferably predetermined in a manner to be described below, to achieve acceptably small error between a corrected speech level (determined in step (c)) for a noisy speech signal and a reference speech level (also determined in step (c)) for the same speech signal in the absence of noise, over a sufficiently wide range of signal to noise ratio (SNR). The parameter n is multiplied by the standard deviation difference value ($S_{est}(f)-S_{prio}(f)$) in equation (1), and is thus indicative of the number of multiples of the standard deviation difference value employed to perform bias correction.

In typical embodiments, the inventive method includes steps of: (a) performing voice detection on an audio signal (e.g., using a conventional voice activity detector or VAD) to identify at least one voice segment of the audio signal; (b) for each said voice segment, determining a parametric spectral model of content of each frequency band of a set of perceptual frequency bands of the voice segment; and (c) for said each frequency band of said each voice segment, correcting an estimated voice level determined by the model for the frequency band, using a predetermined characteristic of reference speech. The reference speech is typically speech (without significant noise) uttered by an individual speaker or an average of speech uttered by many speakers. Preferably, the parametric spectral model is a Gaussian parametric spectral model which determines values $M_{est}(f)$ and $S_{est}(f)$ (as described with reference to equation (1)) for each perceptual frequency band f of each said voice segment, the estimated voice level for each said perceptual frequency band f is the value $M_{est}(f)$, and step (c) includes a step of employing a predetermined reference standard deviation value (e.g., $S_{prio}(f)$ in Equation 1) for each said perceptual band to correct the estimated voice level for the band.

Aspects of the invention include a system or device configured (e.g., programmed) to perform any embodiment of the inventive method, and a computer readable medium (e.g., a disc) which stores code (in tangible form) for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and a processing subsystem that is programmed (and/or otherwise configured) to perform an embodiment of the inventive method (or steps thereof) in response to data asserted thereto.

The invention has many commercially useful applications, including (but not limited to) voice conferencing, mobile devices, gaming, cinema, home theater, and streaming applications. A processor configured to implement any of various embodiments of the inventive method can be included any of a variety of devices and systems (e.g., a speaker phone or other voice conferencing device, a mobile device, a home theater or other audio playback system, or an audio encoder). Alternatively, a processor configured to implement any of various embodiments of the inventive method can be coupled via a network (e.g., the internet) to a local device or system, so that (for example) the processor can provide data indicative of a result of performing the method to the local system or device (e.g., in a cloud computing application).

In voice conferencing and mobile device applications, typical embodiments of the inventive method and system can determine the speech level of an audio signal (e.g., to be reproduced using a loudspeaker of a mobile device or speaker phone) irrespective of noise level. Noise suppressors could be employed in such applications (and in other applications) to remove noise from the speech signal either before or after the speech level determination (in the signal processing sequence).

In cinema applications, embodiments of the inventive method and system could (for example) determine the level of a speech signal in connection with automatic DIALNORM setting or a dialog enhancement strategy. For example, an embodiment of the inventive system (e.g., included in an audio encoding system) could process an audio signal to determine a speech level thereof, thus determining a DIALNORM parameter (indicative of the determined level) for inclusion in an AC-3 encoded version of the signal. A DIALNORM parameter is one of the audio metadata parameters included in a conventional AC-3 bitstream for use in changing the sound of the program delivered to a listening environment. The DIALNORM parameter is intended to indicate the mean level of speech (e.g., dialog) occurring an audio program, and is used to determine audio playback signal level. During playback of a bitstream comprising a sequence of different audio program segments (each having a different DIALNORM parameter), an AC-3 decoder uses the DIALNORM parameter of each segment to modify the playback level or loudness of such that the perceived loudness of the dialog of the sequence of segments is at a consistent level.

DETAILED DESCRIPTION OF THE PREFERRED EMBODIMENTS

Many embodiments of the present invention are technologically possible. It will be apparent to those of ordinary skill in the art from the present disclosure how to implement them. Embodiments of the inventive system and method will be described with reference to FIGS. 2-7.

Figure 3:
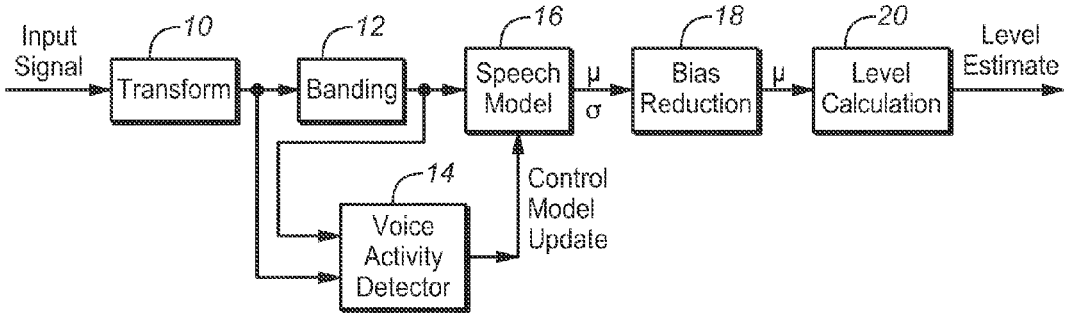
FIG. 3 is a block diagram of a system configured to determine bias corrected speech level values in accordance with any of various embodiments of the inventive method. Stages 10, 12, 14, 16, and 20 of the FIG. 3 system can be implemented in a conventional manner. Stage 18 implements correction (bias reduction) in accordance with an embodiment of the invention to determine a bias corrected estimated sound level for each frequency band f of each voice segment identified by stage 14.

With reference to FIG. 3, we describe an embodiment of the inventive system which includes transform stage 10, banding stage 12, voice activity detector ("VAD") 14, speech model implementing stage 16, bias reduction stage 18, and speech level determination stage 20, coupled as shown. Stage 10 is configured to perform time-to-frequency domain transformation on a time-domain input audio signal (blocks of audio data indicative of a sequence of audio samples) to generate a frequency-domain input audio signal (audio data indicative of a sequence of frames of frequency components, typically in uniformly spaced frequency bins). Each of stages 10, 12, 14, 16, and 20 of the FIG. 3 system can be implemented in a conventional manner. In alternative embodiments of the inventive system, the input to the system is frequency-domain audio data or an audio signal indicative of frequency-domain audio data, and transform stage 10 is omitted.

Banding stage 12 of FIG. 3 is configured to generate banded data in response to the output of stage 10, by assigning the frequency coefficients output from stage 10 into perceptually-relevant frequency bands (typically having nonuniform width) and to assert the banded data to VAD 14 and stage 16. The bands are typically determined by a psychoacoustic model such that equal steps on the frequency scale determined by the bands correspond to perceptually equal distances. Examples of perceptually-relevant frequency bands into which stage 12 may assign the frequency components output from stage 10 are: a set of 32 nonuniform bands matching (or approximating) the frequency bands of the well known psychoacoustic scale known as the Equivalent Rectangular Bandwidth (ERB) scale, or a set of 50 nonuniform bands matching (or approximating) the frequency bands of the well known psychoacoustic scale known as the Bark scale.

VAD 14 processes the stream of banded data output from stage 12 to identify segments of the audio data that are indicative of speech content ("voice segments" or "speech segments"). Each voice segment may be a set of N consecutive frames (e.g., one frame or more than one frame) of the audio data. The magnitude of the data value (a frequency component) for each frequency band of each time interval of a voice segment (e.g., each time interval corresponding to a frame of the voice segment) is a speech level. Block 16 determines a parametric spectral model of the content of each voice segment identified by VAD 14 (each segment of the audio data determined by VAD 14 to be indicative of speech content). The model determines a distribution of speech level values (the speech level at each of a number of different times during assertion of the voice segment to block 16) for each frequency band of the audio data of the segment, and an estimated speech level (e.g., estimated mean speech level) for each frequency band of the segment. The model is updated (replaced by a new model) in response to each control value from VAD 14 indicating the start of a new voice segment.

For example, in response to a voice segment, a preferred implementation of block 16 determines a histogram of the speech level values of each frequency band of the voice segment (i.e., organizes the speech level values into the histogram), and approximates the histogram's envelope as a Gaussian function. For example, for each frequency band (of the data of a voice segment) block 16 may determine a histogram (and a Gaussian function) of form such as those shown in the top graph of FIG. 6. In this implementation, block 16 identifies the speech level at the Gaussian's midpoint (e.g., the level approximately equal to −65 dB in the top graph of FIG. 6) as the estimated mean speech level of the frequency band, and the Gaussian's standard deviation as the standard deviation of the speech levels comprising the histogram for the frequency band. Such an estimated mean speech level for frequency band f is referred to as the value "$M_{est}(f)$" in above-described equation (1), to be further discussed below, and such a standard deviation value for frequency band f is referred to as the value "$S_{est}(f)$" in equation (1).

Bias reduction stage 18 is configured to correct, in accordance with an embodiment of the invention, the estimated speech levels determined by stage 16 for all frequency bands of each voice segment, using predetermined correction values. Stage 18 generates bias corrected speech levels for all frequency bands of each voice segment. The correction operation corrects the estimated speech level (determined in stage 16) for each frequency band (thereby determining a bias corrected speech level for each band), so as to correct for bias that may have been introduced by compression of, and/or the presence of noise with, the speech signal input to stage 10. Prior to operation of the FIG. 3 system to implement an embodiment of the inventive method, the correction values would be provided to (e.g., stored in) stage 18.

A reference speech model is typically predetermined and the correction values are determined from such model. The reference speech model is a parametric spectral model determining a speech level distribution (preferably a Gaussian distribution) for each frequency band of reference speech, each such band corresponding to one of the frequency bands of the banded output of stage 12. A correction value is determined from each such speech level distribution. The reference speech model can be predetermined from speech uttered by an individual speaker or by averaging distribution parameterizations predetermined from speech uttered by many speakers.

Speech level determination stage 20 is configured to determine a corrected speech level for each voice segment, in response to the corrected speech levels (output from stage 18) for the individual frequency bands of the voice segment. Stage 20 may implement a conventional method for performing such operation. For example, stage 20 may implement a method of the above-mentioned type (described in the cited Soulodre paper) in which the speech levels for the individual bands (in this case, the corrected levels generated in stage 18 in accordance with the present invention) of each voice segment undergo perceptually relevant weighting to determine weighted levels for the voice segment, and the weighted levels are then summed and averaged over a time interval (e.g., a time interval corresponding to the segment's duration) to determine an equivalent sound level for the segment. Examples of a weighting which may be implemented include any of the conventional A-, B-, C-, D-, M (Dolby), RLB (Revised Low-frequency B), Bhp (Butterworth high-pass filter), and ATH weightings.

For example, stage 20 may be configured to compute a bias-corrected level "$Leq_{cor}$" for each voice segment as follows. Stage 20 determines a set of values $(x_W)_2/(x_{REF})_2$ for the segment, where each value $x_W$ is the weighted loudness level corresponding to (e.g., produced at) a time, t, during the segment (so that each value $x_W$ is a weighted loudness level for one of the frequency bands), and $x_{REF}$ is a reference level for the frequency band. Stage 20 then computes $Leq_{cor}$ for the segment to be $Leq=10\log_{10}(I/T)$, where I is the integral of the $(x_W)^2/(x_{REF})^2$ values over a time interval T, and T is of sufficient duration to include the times associated with the values $(x_W)^2/(x_{REF})^2$ for all the frequency bands for the segment. Stage 20 asserts output data indicative of the bias-corrected level for each voice segment identified by VAD 14.

For another example, stage 20 may apply perceptual weighting to the corrected speech levels for the individual frequency bands of each voice segment (as described in the previous two paragraphs), and aggregate the weighted, corrected speech levels for the individual bands to generate an estimate of the instantaneous speech level for the segment. Stage 20 may then apply a low pass filter (LPF) to a sequence of such instantaneous estimates (for a sequence of voice segments) to generate a low pass filtered output indicative of bias corrected speech level as a function of time. In some embodiments, stage 20 may omit the weighting of the corrected speech levels for the individual frequency bands of each voice segment, and simply aggregate the unweighted levels to determine the estimate of the instantaneous speech level for the segment.

In a typical implementation of the FIG. 3 system, stage 16 is configured to determine an estimated mean speech level, $M_{est}(f)$, and a standard deviation value, $S_{est}(f)$, for each frequency band f of each voice segment identified by VAD 14, including by determining a histogram of the speech level values of each frequency band of the voice segment and approximating the histogram's envelope as a Gaussian function (as described above). In this implementation of the FIG. 3 system, block 18 is configured to implement bias reduction to determine a bias corrected sound level, $M_{biascorrected}(f)$, for each frequency band f of each voice segment, as follows:

$$M_{biasconected}(f)=M_{est}(f)+n(S_{est}(f)-S_{prio}(f)) \quad (1),$$

where $S_{prio}(f)$ is a reference standard deviation (predetermined from a reference speech model) for frequency band f, and the parameter n is a predetermined integer. The reference speech model is a Gaussian model, and $S_{prio}(f)$ is the standard deviation of the Gaussian which approximates the speech level distribution (predetermined from the reference speech model) for frequency band f. The parameter n is preferably predetermined empirically (e.g., in a manner to be described with reference to FIG. 7) to achieve acceptably small error between a bias corrected speech level determined (using equation (1)) for a noisy speech signal and a reference speech level (also determined using equation (1)) for the same speech signal in the absence of noise, over a sufficiently wide range of signal to noise ratio (SNR).

Figure 7:
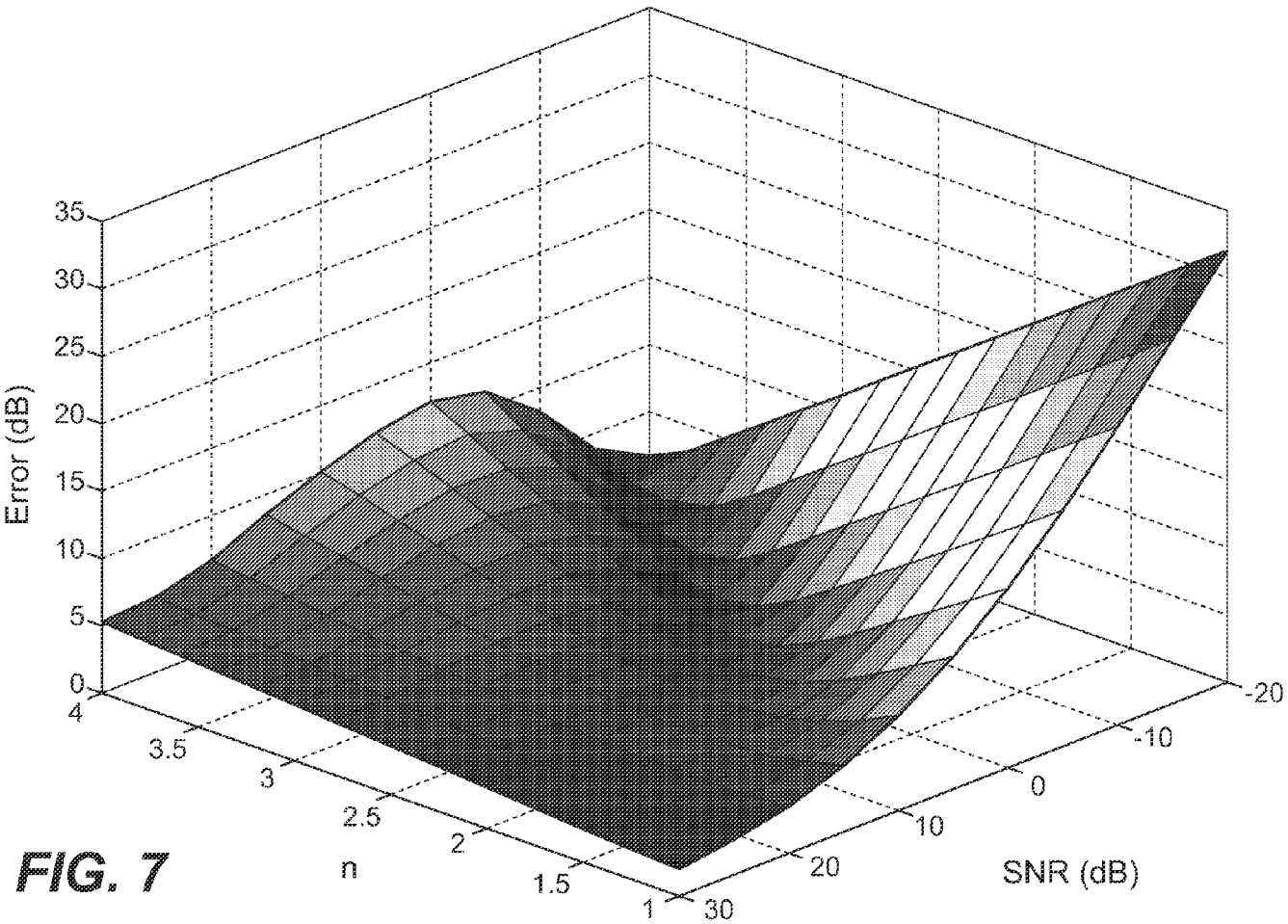
FIG. 7 is a graph of error values (plotted, in units of dB, on the vertical axis) denoting the difference between a speech level determined (for each plotted point) from a noisy speech signal in accordance with the invention using equation (1), and a reference RMS speech level determined (in accordance with the same embodiment of the invention) from the speech signal in the absence of noise, with parameter n (of equation (1)) having a value equal to each of 1, 1.5, 2, 2.5, 3, 3.5, and 4.

FIG. 7 is a graph of error values (plotted in units of dB on the vertical axis), each denoting the difference between a speech level determined (for each plotted point) from a noisy speech signal in accordance with the invention using equation (1), and a reference RMS speech level determined (in accordance with the same embodiment of the invention) from the speech signal in the absence of noise, with parameter n having a value equal to each of 1, 1.5, 2, 2.5, 3, 3.5, and 4. As is apparent from FIG. 7, values of n=2 to 2.5 provide good performance (low error) over the widest range of signal to noise ratio (SNR). At lower SNR, only the upper portion of the speech level distribution (determining the Gaussian function) remains uncorrupted by noise. The inventors have observed that higher values of n (e.g., n=3.5 or n=4) are capable of reaching low error with noisy speech signals having low SNR (e.g., SNR=−20 dB as shown in FIG. 7), albeit at the expense of a limited SNR range (i.e., such higher values of n are not suitable for use with speech signals having higher SNR (e.g., SNR=0 dB or 10 dB, as shown in FIG. 7).

Figure 1:
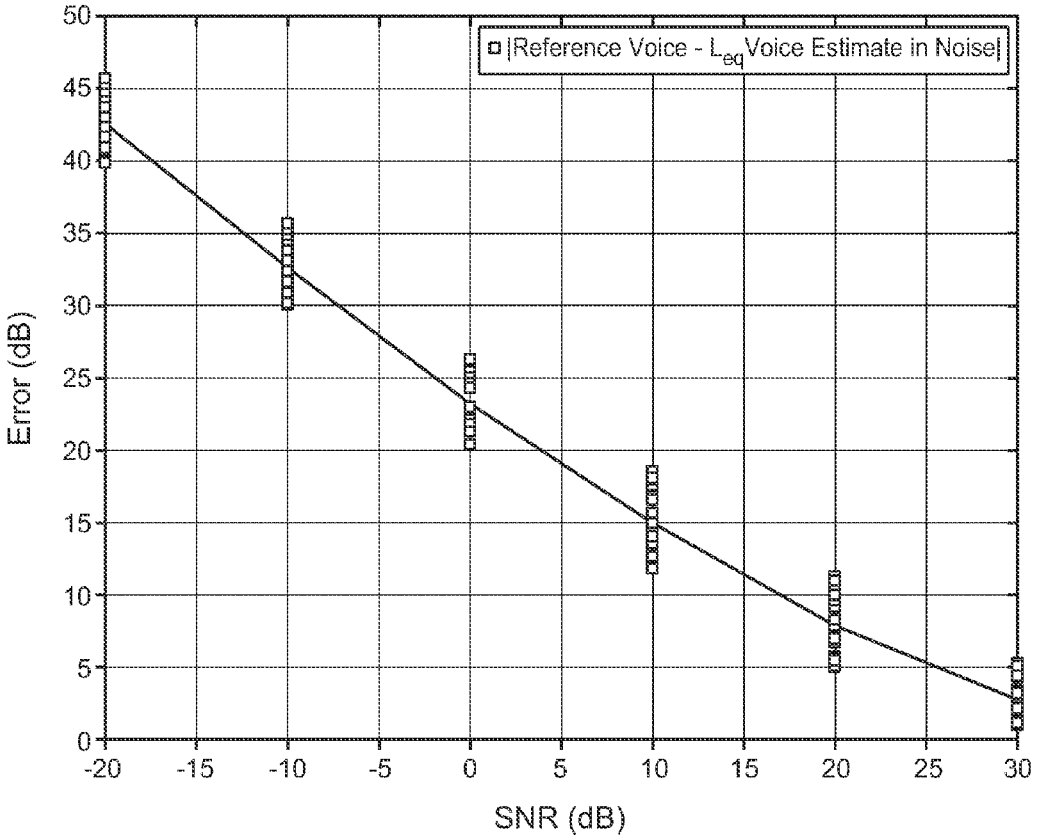
FIG. 1 is a graph of results of applying a conventional speech level estimating method to a range of input voice signals with varying levels and varying signal to noise ratios (SNR values). The error in dB (plotted on the vertical axis) denotes the discrepancy between the conventionally measured speech level (for each plotted point) in relation to a reference RMS voice level calculated in the absence of noise.
Figure 2:
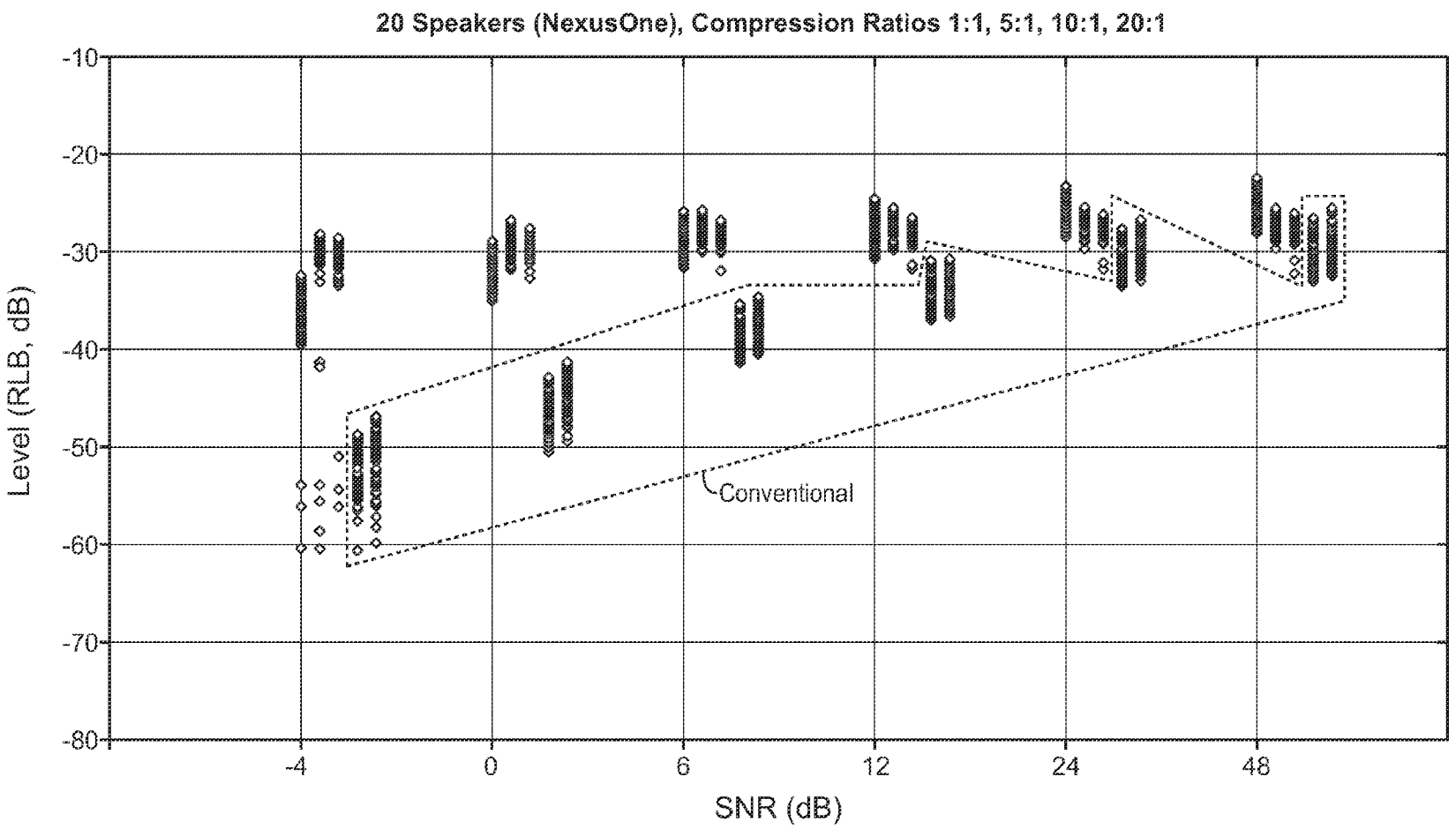
FIG. 2 is a graph illustrating the comparative performance of a typical embodiment of the inventive method compared to a conventional speech level measurement method. Each speech level value plotted in FIG. 2 represents the result of applying Automatic Gain Control (AGC) to a noisy speech signal using a sequence of measured speech levels determined from the signal. The speech level values within the region labeled "CONVENTIONAL" in FIG. 2 represent the result of applying AGC using speech level estimates determined by a conventional speech level measurement method (of the type described in the Soulodre paper). The other speech level values plotted in FIG. 2 represent the result of applying AGC using bias corrected speech level estimates determined in accordance with the present invention.

FIG. 2 is a graph illustrating the comparative performance of a typical embodiment of the inventive method compared to a conventional speech level measurement method. Each speech level value plotted in FIG. 2 represents the result of applying Automatic Gain Control (AGC) to a noisy speech signal using a sequence of measured speech levels determined from the signal. The speech level values within the region labeled "CONVENTIONAL" in FIG. 2 represent the result of applying AGC using speech level estimates determined by a conventional speech level measurement method (of the type described in the Soulodre paper). The other speech level values plotted in FIG. 2 represent the result of applying AGC using bias corrected speech level estimates determined in accordance with the present invention. The difference between the conventional method and the inventive method employed is essentially that in the inventive method, nonzero reference standard deviation values $S_{prio}(f)$ for the frequency bands of the signal are employed as in equation (1), but in the conventional method, the reference standard deviation values $S_{prio}(f)$ are replaced by zero values. As is apparent from FIG. 2, the desired output level of the AGC (−30 dB RMS) was not achieved using the conventional speech level estimation for any signal to noise ratio (SNR) except the highest SNRs (greater than 48 dB). The desired output level of the AGC was achieved using the bias corrected speech levels for various SNRs and amplitude compression ratios, due to the improved level measurement accuracy provided by the inventive method.

To generate the data plotted in FIG. 2, varying amounts of noise and amplitude compression were applied to a speech signal to produce noisy speech signals (whose speech levels were measured), and AGC was performed on the noisy speech signals using the measured speech levels. For each SNR ratio, the compression ratios applied to produce the noisy speech signals included 1:1, 5:1, 10:1, and 20:1. The noisy speech signals were output from a Nexus One phone, and sampled to generate the acoustic data actually processed. In FIG. 2, the SNR of each noisy speech signal is indicated by position of the corresponding plotted value along the horizontal axis. The position of each plotted value along the vertical axis indicates level of the corresponding noisy speech signal (after application of AGC).

The parametric spectral model of the speech content of a voice signal (e.g., a voice segment identified by VAD 14 of FIG. 3) determined (e.g., by stage 16 of FIG. 3) during performance of the inventive method determines a distribution of speech level values for each frequency band. The distribution (e.g., the Gaussian curve approximating the histogram of the top graph of FIG. 6, or a Gaussian curve approximating the histogram of the bottom graph of FIG. 6) exhibits a characteristic mean speech level and a characteristic variance. When the voice signal is indicative of typical speech, and is uncompressed and has a low noise floor, the mean speech level has a specific value and the variance has a specific value. With increasing amounts of compression applied to the voice signal, or as the noise increases (i.e., as SNR decreases), the mean speech level exhibits an upward bias (it shifts to a higher value, as is apparent from below-discussed FIG. 4) and the variance is reduced.

We next describe illustrative examples of several embodiments of the invention.

Figure 4:
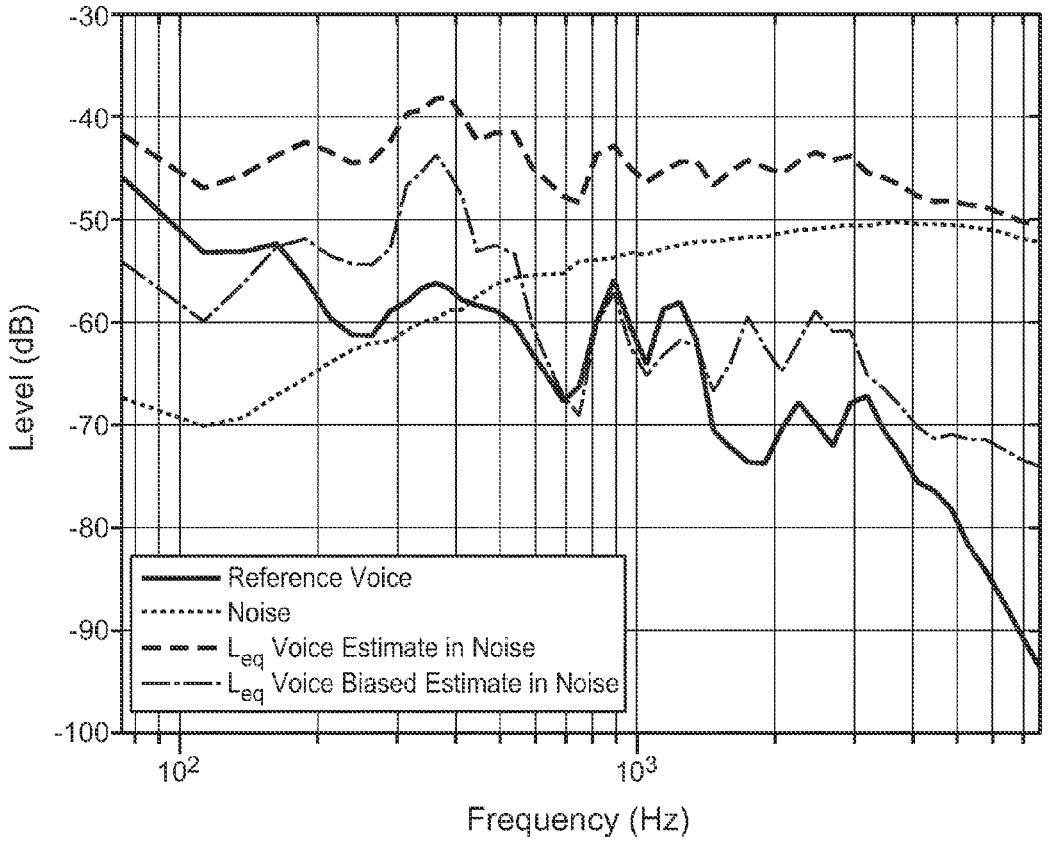
FIG. 4 is a graph representing voice and noise spectra across a set of frequency bands. The "Reference Voice" curve represents the spectrum of speech without noise. However, during typical speech level measurements on an audio signal indicative of such speech, the audio signal is also indicative of noise. The "Noise" curve in FIG. 4 represents the noise component of such a noisy audio signal. The curve labeled "$L_{eq}$ Voice Estimate in Noise" represents the mean speech levels determined by a conventional parametric spectral model of the noisy audio signal (i.e., a mean speech level $L_{eq}$ determined from the model for each frequency band). The curve labeled "$L_{eq}$ Voice Biased Estimate in Noise" represents the bias corrected mean speech levels generated by correcting the levels $L_{eq}$ of the "$L_{eq}$ Voice Estimate in Noise" curve in accordance with an embodiment of the invention.

FIG. 4 is a graph representing voice and noise spectra across a set of frequency bands. The "Reference Voice" curve represents the spectrum of speech without noise. However, during typical speech level measurements on an audio signal indicative of such speech, the audio signal is also indicative of noise. The "Noise" curve in FIG. 4 represents the noise component of such a noisy audio signal. The curve labeled "$L_{eq}$ Voice Estimate in Noise" represents the mean speech levels determined by a conventional parametric spectral model of the noisy audio signal (i.e., a mean speech level $L_{eq}$ determined, in an implementation of stage 16 of the FIG. 3 system, from the model for each frequency band). The curve labeled "$L_{eq}$ Voice Biased Estimate in Noise" represents the bias corrected mean speech levels generated by correcting (in stage 20 of an implementation of the FIG. 3 system) the levels $L_{eq}$ of the "$L_{eq}$ Voice Estimate in Noise" curve in accordance with an embodiment of the invention. It is apparent from FIG. 4 that the "$L_{eq}$ Voice Biased Estimate in Noise" better corresponds to the Reference Voice curve than does the "$L_{eq}$ Voice Biased Estimate in Noise" curve, and that the "$L_{eq}$ Voice Biased Estimate in Noise" curve is shifted upward relative to the Reference Voice curve (i.e., exhibits an upward bias).

Figure 5:
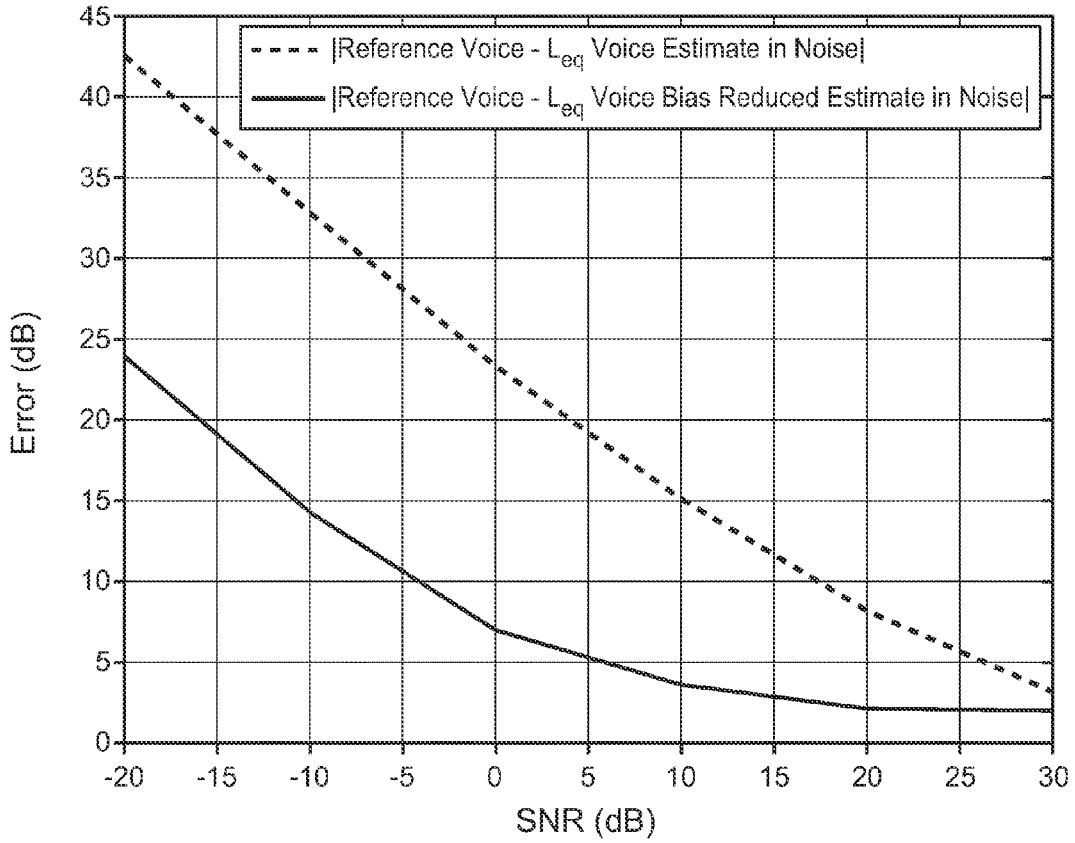
FIG. 5 is a graph of comparison of error of conventionally measured speech levels (the curve labelled "|Reference Voice−$L_{eq}$ Voice Estimate in Noise|") and error of speech levels measured in an accordance with an embodiment of the invention (the curve labeled "|Reference Voice−$L_{eq}$ Voice Bias Reduced Estimate in Noise|") for various noisy speech input signals having different signal to noise ratios. The error (plotted on the vertical axis) is the absolute value of the difference between a reference RMS speech level ("Reference Voice" level) in the absence of noise and the measured levels.

FIG. 5 compares error of speech levels measured by a conventional speech level measuring method with error of speech levels measured (e.g., indicated by signals output from stage 20 of the FIG. 3 system) by an embodiment of the present invention, where the measured noisy speech signals are indicative of noise added (with a variety of different gains) to speech ("Reference Voice"). The measured speech signals thus have a variety of signal to noise ratios (indicated by position along the horizontal axis). The error (plotted on the vertical axis) denotes the absolute value of the difference between the RMS level of the speech in the absence of noise ("Reference Voice") and the measured level of the noisy signal. The conventionally determined levels (the curve labelled "|Reference Voice−$L_{eq}$ Voice Estimate in Noise|") show a large upward bias at low signal to noise ratios, in the sense that the difference, $L_{eq}$ Voice Estimate in Noise−Reference Voice, between the measured level ($L_{eq}$ Voice Estimate in Noise) and the Reference Voice value is positive and large at low signal to noise ratios. In contrast, the levels measured in accordance with the invention (the curve labelled "|Reference Voice−$L_{eq}$ Voice Bias Reduced Estimate in Noise|") exhibit decreased upward bias over the range of signal to noise ratios.

Figure 6:
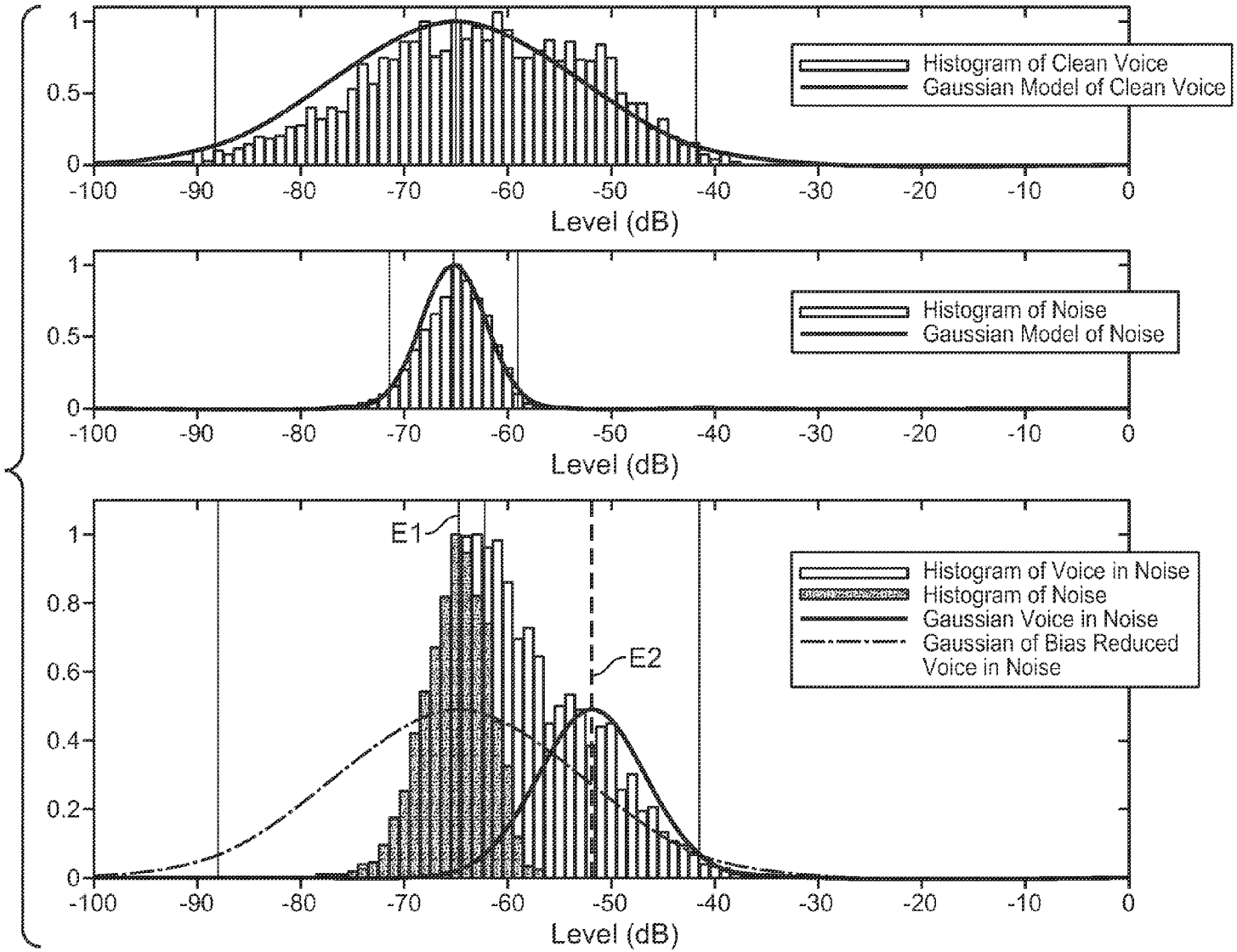
FIG. 6 is a set of three graphs pertaining to bias reduced speech level estimation performed (in accordance with an embodiment of the invention) on voice with additive Gaussian noise, with a 20 dB signal to noise ratio. The top graph is the log level distribution of a single frequency band (center frequency 687.5 Hz) of clean voice, approximated by a Gaussian, in which the center vertical dotted line indicates the mean and the other vertical dotted lines indicate +/−2 standard deviations. The middle graph is the distribution of a Gaussian noise source. The bottom graph is the log level distribution of the signal (represented by the top graph) with the noise (represented by the middle graph) added thereto so as to produce a noisy signal having an RMS signal to noise ratio of 20 dB.

FIG. 6 is a set of three graphs pertaining to bias reduced speech level estimation performed (in accordance with an embodiment of the invention) on voice with additive Gaussian noise, with a 20 dB signal to noise ratio. The top graph is the log level distribution of a single frequency band (having center frequency 687.5 Hz) of a clean voice signal, approximated by a Gaussian, in which the center vertical dotted line indicates the mean level (about −65 dB) and the other vertical dotted lines indicate +/−2 standard deviations. The top graph includes a histogram of speech level values (e.g., values output sequentially from stage 12, and organized by stage 16 of FIG. 3) for the frequency band.

The middle graph of FIG. 6 is the log level distribution of a Gaussian noise source in the same frequency band (having center frequency 687.5 Hz). The middle graph includes a histogram of noise level values (e.g., values output sequentially from stage 12 in response to the noise, and organized into the histogram by stage 16 of FIG. 3) for the band.

The bottom graph of FIG. 6 is the log level distribution of the signal (represented by the top graph) with the noise (represented by the middle graph) added thereto (with gain applied to the noise so as to produce a noisy signal having an RMS signal to noise ratio of 20 dB, thereby shifting the distribution shown in the middle graph). The bottom graph includes a histogram of level values (e.g., values output sequentially from stage 12 in response to the noisy signal, and organized into the histogram by stage 16 of FIG. 3) for the band. The values comprising this histogram are shown in light grey, and the bottom graph of FIG. 6 also includes (for purposes of comparison) a histogram (whose values are shown in a dark grey) of the noise level values of the noise component of the noisy signal. In the bottom graph of FIG. 6, the addition of noise to the clean voice adversely affects the estimation of the voice distribution, increasing the level estimate to the position of vertical line E2 (the mean of the histogram shown in the bottom graph, corresponding to a level of about −51 dB) from the position of vertical line E1 (corresponding to a level of about −65 dB). Since the position of vertical line E1 is the true level of the speech (ignoring the noise) as apparent from the top graph, it is apparent that the introduction of noise intrudes on the voice model and causes the speech level to be measured (conventionally) to be higher than it really is. Applying bias correction (in accordance with the invention) as in Equation 1 to the conventionally determined mean level ($M_{est}(f)$ in equation 1, which is equal to about −51 dB as shown in the bottom graph) with parameter n equal to 2 and $S_{prio}(f)=11$, determines the bias corrected level ($M_{biascorrected}(f)$ in equation 1, which is equal to about −65 dB as shown in the bottom graph) which more accurately matches the mean of the clean voice distribution in the top graph. Note that the value $S_{prio}(f)=11$ will be valid for all frequency bands, assuming that level distribution for each frequency band of clean voice (i.e., reference speech) is uniform across all frequency bands (i.e., so that the level distribution is as shown in the top graph of FIG. 6 in all frequency bands). More generally, $S_{prio}(f)$ for each frequency band can be calculated by computing the standard deviation of the level distribution each frequency band of each reference speech signal (of a set of reference speech recordings or other reference speech signals) and averaging the standard deviations determined from all the reference speech signals.

Estimating the voice in noise in a conventional manner produces a biased estimate of level (e.g., the level determined by vertical line "E2" in the bottom graph of FIG. 6) due to the noise distribution. However, applying Equation 1 in accordance with the present invention corrects for the bias, producing a corrected estimate of level (e.g., the level determined by vertical line "E1"). The corrected voice level estimate in noise (the level determined by line "E1" in the bottom graph) matches the level of the clean voice modeled in the top graph.

Typical embodiments of the invention have been shown to provide accurate measurement of speech level of speech signals indicative of different human voices (four female voices and sixteen male voices), speech signals with various SNRs (e.g., −4, 0, 6, 12, 24, and 48 dB), and speech signals with various compression ratios (e.g., 1:1, 5:1, 10:1, and 20:1).

In a class of embodiments, the invention is a method of generating a speech level signal from a speech signal (e.g., a signal indicative of speech data, or another audio signal) indicative of speech, wherein the speech level signal is indicative of level of the speech, and the speech level signal is generated in a manner which corrects for bias due to presence of noise with and/or amplitude compression of the speech signal (and is preferably at least substantially invariant to changes in such bias due to addition of noise to the speech signal and/or amplitude compression of the speech signal). In typical embodiments, the speech signal is a voice segment of an audio signal (typically, one that has been identified using a voice activity detector), and the method includes a step of determining (e.g., in stage 16 of the FIG. 3 system, from frequency domain audio data indicative of the voice segment) a parametric spectral model of content of the voice segment. Preferably, the parametric spectral model is a Gaussian parametric spectral model. The parametric spectral model determines a distribution (e.g., a Gaussian distribution) of speech level values (e.g., speech level at each of a number of different times during assertion of the speech signal) for each frequency band (e.g., each Equivalent Rectangular Bandwidth (ERB) or Bark frequency band) of the voice segment, and an estimated speech level (e.g., estimated mean speech level) for each frequency band of the voice segment. Taking advantage of the fact that speech has a relatively fixed dynamic range, "a priori" knowledge of the speech level distribution (for each frequency band) of typical (reference) speech is used (e.g., in stage 18 of the FIG. 3 system) to correct the estimated speech level determined for each frequency band (thereby determining a corrected speech level for each band), to correct for bias that may have been introduced by compression of, and/or noise addition to, the speech signal. Typically a reference speech model is predetermined, such that the reference speech model is a parametric spectral model determining a speech level distribution (for each frequency band) of reference speech, and the reference speech model is used to predetermine a set of correction values. The predetermined correction values are employed (e.g., in stage 18 of the FIG. 3 system) to correct the estimated speech levels determined for all frequency bands of the voice segment. The reference speech model can be predetermined from speech uttered by an individual speaker or by averaging distribution parameterizations predetermined from speech uttered by many speakers. The corrected speech levels for the individual frequency bands are employed (e.g., in stage 20 of the FIG. 3 system) to determine a corrected speech level for the speech signal.

In a class of embodiments, the inventive method includes steps of:

(a) generating (e.g., in stage 16 of the FIG. 3 system), in response to frequency banded, frequency-domain data indicative of a speech signal (e.g., a voice segment of an audio signal identified by voice activity detector 14 of the FIG. 3 system), a Gaussian parametric spectral model of the speech signal, and determining from the parametric spectral model an estimated mean speech level and a standard deviation value for each frequency band (e.g., each ERB frequency band, Bark frequency band, or other perceptual frequency band) of the data; and (b) generating speech level data (e.g., in stage 18 of the FIG. 3 system) indicative of a bias corrected mean speech level for said each frequency band, including by using at least one correction value to correct the estimated mean speech level for the frequency band, wherein each said correction value has been predetermined using a reference speech model.

Typically also, the method includes a step of: (c) generating a speech level signal (e.g., in stage 20 of the FIG. 3 system) indicative of a corrected speech level for the speech signal from the speech level data generated in step (b).

The method may also include a step of generating (e.g., in stages 10 and 12 of the FIG. 3 system) the frequency banded, frequency-domain data in response to an input audio signal. The speech signal may be a voice segment of the input audio signal.

Preferably, the reference speech model is Gaussian parametric spectral model of reference speech (which determines a level distribution for each frequency band of a set of frequency bands of the reference speech), and each of the correction values is a reference standard deviation value for one of the frequency bands of the reference speech.

In preferred embodiments in this class, the parametric spectral model of the speech signal is a Gaussian parametric spectral model, and step (b) includes a step of determining the bias corrected mean speech level for each frequency band, f, to be $M_{biascorrected}(f)=M_{est}(f)+n(S_{est}(f)S_{prio}(f)$, where $M_{biascorrected}(f)$ is the bias corrected mean speech level for band f, $M_{est}(f)$ is the estimated mean speech level for frequency band f (determined from the input speech signal), $S_{est}(f)$ is the standard deviation value (determined from the input speech signal) for frequency band f, and $S_{prio}(f)$ is a reference standard deviation (predetermined from the reference speech model) for frequency band f. Typically, the preferred embodiments include a step of: (c) determining (e.g., in stage 20 of the FIG. 3 system) a corrected speech level for the speech signal from the bias corrected mean speech levels, $M_{biascorrected}(f)$.

In typical embodiments, the inventive method includes steps of: (a) performing voice detection on an audio signal (e.g., using voice activity detector 14 of the FIG. 3 system) to identify at least one voice segment of the audio signal; (b) for each said voice segment, determining (e.g., in stage 16 of the FIG. 3 system) a parametric spectral model of content of each frequency band of a set of perceptual frequency bands of the voice segment; and (c) for said each frequency band of said each voice segment, correcting (e.g., in stage 18 of the FIG. 3 system) an estimated voice level determined by the model for the frequency band, using a predetermined characteristic of reference speech. The reference speech is typically speech (without significant noise) uttered by an individual speaker or an average of speech uttered by many speakers. Preferably, the parametric spectral model is a Gaussian parametric spectral model which determines above-described values $M_{est}(f)$ and $S_{est}(f)$ for each perceptual frequency band f of each said voice segment, the estimated voice level for each said perceptual frequency band f is the value $M_{est}(f)$, and step (c) includes a step of employing a predetermined reference standard deviation value (e.g., above-described $S_{prio}(f)$) for each said perceptual band to correct the estimated voice level for the band.

Aspects of the invention include a system or device configured (e.g., programmed) to perform any embodiment of the inventive method, and a computer readable medium (e.g., a disc) which stores code for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and a processing subsystem that is programmed (and/or otherwise configured) to perform an embodiment of the inventive method (or steps thereof) in response to data asserted thereto.

The FIG. 3 system (with stage 10 optionally omitted) may be implemented as a configurable (e.g., programmable) digital signal processor (DSP) that is configured (e.g., programmed and otherwise configured) to perform required processing on an encoded audio signal (e.g., decoding of the signal to determine the frequency-domain data asserted to stage 12, and other processing of such decoded frequency-domain data), including performance of an embodiment of the inventive method. Alternatively, the FIG. 3 system (with stage 10 optionally omitted) may be implemented as a programmable general purpose processor (e.g., a PC or other computer system or microprocessor, which may include an input device and a memory) which is programmed with software or firmware and/or otherwise configured to perform any of a variety of operations including an embodiment of the inventive method. A general purpose processor configured to perform an embodiment of the inventive method would typically be coupled to an input device (e.g., a mouse and/or a keyboard), a memory, and a display device.

Another aspect of the invention is a computer readable medium (e.g., a disc) which stores code for implementing any embodiment of the inventive method or steps thereof.

While specific embodiments of the present invention and applications of the invention have been described herein, it will be apparent to those of ordinary skill in the art that many variations on the embodiments and applications described herein are possible without departing from the scope of the invention described and claimed herein. For example, examples mentioned herein of time and/or frequency domain processing (and/or time-to-frequency transformation) of signals are intended as examples and are not intended to limit the claims to require any specific type of processing and/or transformation that is not explicit in the claims. It should be understood that while certain forms of the invention have been shown and described, the invention is not to be limited to the specific embodiments described and shown or the specific methods described.

What is claimed is:

1. A method for determining speech level, said method including steps of:

(a) performing voice detection on an audio signal to identify at least one voice segment of the audio signal;

(b) for each said voice segment, determining a parametric spectral model of content of each frequency band of a set of perceptual frequency bands of the voice segment;

(c) for said each frequency band of each said voice segment, generating data indicative of a corrected estimated speech level, including by correcting an estimated speech level determined by the model for the frequency band using a predetermined characteristic of reference speech; and (d) generating a speech level signal in response to the data generated in step (c), wherein the speech level signal is indicative, for each said voice segment, of a level of speech indicated by the voice segment.

2. The method of claim 1, wherein step (c) includes a step of correcting the estimated voice level determined by the model for each said frequency band, using at least one correction value, wherein each said correction value has been predetermined using a reference speech model.

3. The method of claim 2, wherein the reference speech model is Gaussian parametric spectral model of reference speech which determines a level distribution for each frequency band of a set of frequency bands of the reference speech, and each said correction value is a reference speech standard deviation value for one of the frequency bands of the reference speech.

4. A method for determining speech level, said method including steps of:

(a) performing voice detection on an audio signal to identify at least one voice segment of the audio signal, and for each said voice segment, generating frequency domain audio data indicative of the voice segment and determining a parametric spectral model of content of the voice segment from the frequency domain audio data, where the frequency domain audio data are organized in a set of frequency bands, the spectral model determines a distribution of speech level values for each frequency band of the set, and the spectral model determines an estimated speech level for said each frequency band of the set;

(b) for each said voice segment, generating data indicative of corrected estimated speech levels, including by using correction values determined from a predetermined reference speech model to correct the estimated speech levels for the frequency bands of the set, where the reference speech model determines a reference speech level value distribution for each frequency band of a set of frequency bands of frequency domain audio data indicative of reference speech, and each of the correction values is determined from the reference speech level value distribution for a different one of the frequency bands; and (c) generating a speech level signal in response to the data indicative of corrected estimated speech levels for each said voice segment, wherein the speech level signal is indicative, for each said voice segment, of a level of speech indicated by the voice segment.

5. The method of claim 4, wherein the estimated speech levels determined by the parametric spectral model determine an uncorrected speech level of the speech, and the speech level signal generated in step (c) is indicative of a corrected level of the speech which corrects for bias in the uncorrected speech level due to at least one of presence of noise with and amplitude compression of said speech signal.

6. The method of claim 4, wherein the parametric spectral model is a Gaussian parametric spectral model, and the estimated speech level for each frequency band of the speech signal is an estimated mean speech level.

7. The method of claim 4, wherein the reference speech model is Gaussian parametric spectral model of the reference speech, each said reference speech level value distribution is for a different frequency band of a set of frequency bands of the reference speech, and each of the correction values is a reference speech standard deviation value for one of the frequency bands of the reference speech.

8. A method for determining speech level, said method including steps of:

(a) performing voice detection on an audio signal to identify at least one voice segment of the audio signal, and for each said voice segment, generating frequency banded, frequency domain audio data indicative of the voice segment and generating, in response to the frequency banded, frequency-domain data, a Gaussian parametric spectral model of the voice segment, and determining from the parametric spectral model an estimated mean speech level and a standard deviation value for each frequency band of the data;

(b) generating speech level data indicative of a bias corrected mean speech level for said each frequency band, including by using at least one correction value to correct the estimated mean speech level for the frequency band, wherein each said correction value has been predetermined using a reference speech model; and (c) generating a speech level signal in response to the speech level data generated in step (b) for each said voice segment, wherein the speech level signal is indicative, for each said voice segment, of a level of speech indicated by the voice segment.

9. The method of claim 8, also including a step of:

generating the frequency banded, frequency-domain data, in response to the audio signal.

10. The method of claim 8, wherein the reference speech model is Gaussian parametric spectral model of reference speech which determines a level distribution for each frequency band of a set of frequency bands of the reference speech, and each said correction value is a reference standard deviation value for one of the frequency bands of the reference speech.

11. A system for determining speech level, said system including:

at least one computer processor with a memory a voice detection stage, coupled to receive an audio signal and configured to identify at least one voice segment of the audio signal, and for each said voice segment, to generate frequency banded, frequency-domain data indicative of the voice segment;

a model determination stage, coupled to receive the frequency banded, frequency-domain data indicative of each said voice segment, and configured to generate, in response to the data, a Gaussian parametric spectral model of each said voice segment, and to determine, for each said voice segment, from the parametric spectral model of the voice segment an estimated mean speech level and a standard deviation value for each frequency band of the data indicative of the voice segment;

a correction stage, coupled and configured to generate, for each said voice segment, speech level data indicative of a bias corrected mean speech level for said each frequency band of the data indicative of the voice segment, including by using at least one correction value to correct the estimated mean speech level for the frequency band, wherein each said correction value has been predetermined using a reference speech model; and a speech level signal generation stage, coupled and configured to generate, in response to the speech level data generated in the correction stage for each said voice segment, a speech level signal indicative, for each said voice segment, of a level of speech level indicated by the voice segment.

12. The system of claim 11, wherein the reference speech model is Gaussian parametric spectral model of reference speech which determines a level distribution for each frequency band of a set of frequency bands of the reference speech, and each said correction value is a reference standard deviation value for one of the frequency bands of the reference speech.

* * * * *